US012497966B2

(12) United States Patent
Duan et al.

(10) Patent No.: US 12,497,966 B2
(45) Date of Patent: Dec. 16, 2025

(54) COMPRESSOR WITH BOTTOM COVER AND BEARING BLOCK ARRANGEMENT

(71) Applicant: Copeland Climate Technologies (Suzhou) Co. Ltd., Jiangsu (CN)

(72) Inventors: Zhenfei Duan, Suzhou (CN); Litao Liu, Suzhou (CN); Haijin Xu, Suzhou (CN); Xiaoyan Wang, Suzhou (CN); Bin Li, Suzhou (CN); Simon Lenaerts, Suzhou (CN); Pierre Poysat, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 40 days.

(21) Appl. No.: 18/034,321

(22) PCT Filed: Nov. 19, 2020

(86) PCT No.: PCT/CN2020/129998
§ 371 (c)(1),
(2) Date: Apr. 27, 2023

(87) PCT Pub. No.: WO2022/088308
PCT Pub. Date: May 5, 2022

(65) Prior Publication Data

US 2023/0383751 A1 Nov. 30, 2023

(30) Foreign Application Priority Data

Oct. 29, 2020 (CN) ..... 202011179429.3
Oct. 29, 2020 (CN) ..... 202022461376.6

(51) Int. Cl.
*F04C 29/06* (2006.01)
*F04C 29/00* (2006.01)

(52) U.S. Cl.
CPC ..... *F04C 29/06* (2013.01); *F04C 2230/231* (2013.01); *F04C 2240/30* (2013.01)

(58) Field of Classification Search
CPC .. F04C 29/06; F04C 29/0085; F04C 2240/50; F04C 2230/231; F04C 23/008; F01C 21/10
See application file for complete search history.

(56) References Cited

U.S. PATENT DOCUMENTS 4,768,936 A * 9/1988 Etemad ..... F04C 29/023 418/94
5,039,287 A * 8/1991 Da Costa ..... F04C 23/008 418/47

(Continued)

FOREIGN PATENT DOCUMENTS

CN 201953616 U * 8/2011
CN 105545708 A 5/2016

(Continued)

OTHER PUBLICATIONS

English Machine Translation of CN-210343699-U (Year: 2020).*

(Continued)

*Primary Examiner* — Nathan C Zollinger
(74) *Attorney, Agent, or Firm* — Harness, Dickey & Pierce, P.L.C.

(57) ABSTRACT

A compressor includes: a housing including a cylindrical body, and a first cover and a second cover which are respectively arranged at two axial ends of the cylindrical body; a compression mechanism accommodated in the housing and constructed to compress a working fluid; a crankshaft constructed for driving the compression mechanism; a motor constructed to drive the crankshaft to rotate; and a bearing block accommodated in a space defined by the motor and the housing and fixedly attached to the housing, wherein the bearing block is constructed to rotatably support (Continued)

the crankshaft by means of a bearing. The housing is provided with a cylindrical reinforcing portion used for defining a space, and the rigidity of the cylindrical reinforcing portion being greater than that of other parts of the housing. The structure can significantly reduce noise radiation and reduce manufacturing processes and costs.

12 Claims, 10 Drawing Sheets

(56) References Cited

U.S. PATENT DOCUMENTS

| | | | | |
|---|---|---|---|---|
| 5,328,338 | A * | 7/1994 | Hirano | F04B 39/121 137/527 |
| 7,878,775 | B2 * | 2/2011 | Duppert | F04C 23/008 418/57 |
| 9,429,157 | B2 * | 8/2016 | Lee | F04C 23/008 |
| 2006/0140791 | A1 * | 6/2006 | Deming | F04C 18/3564 417/410.3 |
| 2016/0115958 | A1 | 4/2016 | Ignatiev et al. | |
| 2020/0136463 | A1 | 4/2020 | Fukumitsu et al. | |

FOREIGN PATENT DOCUMENTS

| | | | | |
|---|---|---|---|---|
| CN | 206655813 | U | | 11/2017 |
| CN | 209654236 | U | | 11/2019 |
| CN | 110762913 | A | | 2/2020 |
| CN | 210343699 | U | * | 4/2020 |
| CN | 210440220 | U | | 5/2020 |
| CN | 211082277 | U | | 7/2020 |
| CN | 213684518 | U | | 7/2021 |
| JP | 58015786 | A | * | 1/1983 |
| JP | 3403783 | B2 | * | 5/2003 |
| JP | 2013104341 | A | | 5/2013 |
| JP | 6535153 | B2 | | 6/2019 |
| JP | 2019178664 | A | | 10/2019 |
| JP | 2020007910 | A | | 1/2020 |
| KR | 20180091147 | A | | 8/2018 |
| WO | WO-2015060030 | A1 | | 4/2015 |

OTHER PUBLICATIONS

English Machine Translation of CN201953616U (Year: 2011).*

International Search Report (English and Chinese) and Written Opinion of the International Searching Authority (Chinese) issued in PCT/CN2020/129998, mailed Jul. 16, 2021; ISA/CN.

Chinese First Office Action regarding Application No. 202011179429.3, dated Dec. 13, 2024.

Chinese Second Office Action regarding Application No. 202011179429.3, dated May 27, 2025.

* cited by examiner

COMPRESSOR WITH BOTTOM COVER AND BEARING BLOCK ARRANGEMENT

This application is the national phase of International Application No. PCT/CN2020/129998, titled "COMPRESSOR", filed on Nov. 19, 2020, which claims the benefit of priorities to the following two Chinese patent applications, 1) Chinese Patent Application No. 202011179429.3 titled "COMPRESSOR", filed with the China National Intellectual Property Administration on Oct. 29, 2020; and
2) Chinese Patent Application No. 202022461376.6, titled "COMPRESSOR", filed with the China National Intellectual Property Administration on Oct. 29, 2020.

These applications are incorporated herein by reference.

FIELD

The present disclosure relates to a compressor.

BACKGROUND

The contents of this section only provide background information related to the present application, which may not constitute the conventional technology.

A compressor includes: a compression mechanism for compressing working fluid, a crankshaft for driving the compression mechanism, and a bearing block for rotatably supporting the crankshaft through a bearing. The compression mechanism, the crankshaft and the bearing block are accommodated in a housing. Generally, the fixed parts and bearing block in the compression mechanism are fixed to the housing. When the compressor is running, the housing of the compressor vibrates due to the excitation of internal moving parts and radiates noise to the external environment.

SUMMARY

The inventor of the present application found that the noise radiation problem in the space where a lower bearing is located (that is, the space defined by the motor and the lower housing) is serious. In view of this problem, the inventor proposes a technical solution that can significantly reduce noise radiation by simply improving the compressor housing.

An object of the present disclosure is to provide a compressor capable of effectively reducing noise radiation.

Another object of the present disclosure is to provide a compressor, which has a housing that can effectively reduce noise, simplify processing technology and reduce manufacturing cost.

A compressor is provided according to an aspect of the present application. The compressor includes: a housing including a cylindrical body, and a first cover and a second cover respectively arranged at two axial ends of the cylindrical body; a compression mechanism accommodated in the housing and configured to compress a working fluid; a crankshaft configured to drive the compression mechanism; a motor configured to drive the crankshaft to rotate, and a bearing block accommodated in a space defined by the motor and the housing and fixedly attached to the housing, the bearing block is configured to rotatably support the crankshaft through a bearing. The housing has a cylindrical reinforcing part for defining the space, and a rigidity of the cylindrical reinforcing part is greater than a rigidity of other parts of the housing.

In some examples, the first cover includes a base part and an axial extension part, and the axial extension part extends from an outer periphery of the base part in an axial direction of the compressor. The axial extension part is interference-fitted in the cylindrical body to form the cylindrical reinforcing part of the housing. Alternatively, an end of the axial extension part is fixedly attached to an end of the cylindrical body, and a thickness of the axial extension part is greater than a thickness of the cylindrical body, and the axial extension part forms the cylindrical reinforcing part of the housing.

In some examples, the thickness of the axial extension part is greater than or equal to 2 times the thickness of the cylindrical body.

In some examples, the first cover is attached to the cylindrical body via an annular weld seam.

In some examples, a support plate is provided and interference fitted at the end of the axial extension part.

In some examples, the support plate is an annular flat plate.

In some examples, a top of the axial extension part has a concave step surface to support or position the support plate.

In some examples, a gap is formed between an end face of the axial extension part and the bearing block, and the gap is greater than or equal to 0.5 mm and less than or equal to 3 mm.

In some examples, the compressor includes a reinforcement member, and the reinforcement member is interference-fitted in the cylindrical body to form the cylindrical reinforcing part.

In some examples, the reinforcement member includes a cylindrical part in interference fit with the cylindrical body, and a bottom part extending in a radial direction from an end of the cylindrical part. The bottom part is positioned adjacent to the bearing block.

In some examples, the reinforcement member is positioned between the motor and the bearing block, and the end face of the cylindrical part has a shape matching with the stator.

In some examples, the bottom part is annular.

In some examples, the bottom part is connected to the bearing block via a fastener.

In some examples, the reinforcement member is made of a material different from the material of the housing.

In some examples, the compressor is a vertical compressor, and the first cover is a bottom cover, and the bearing block is a lower bearing block.

In some examples, multiple independent support legs are arranged on the bottom cover, and the support legs are equally spaced along a circumferential direction to support the compressor on an external structure.

From the following detailed description, other applications of the present disclosure will become more apparent. It should be understood that, although these detailed descriptions and specific examples show preferred embodiments of the present application, these detailed descriptions and specific examples are intended to achieve the purpose of illustrative description, rather than to limit the present application.

BRIEF DESCRIPTION OF THE DRAWINGS

The features and advantages of one or more embodiments of the present disclosure will become more readily understood from the following description with reference to the accompanying drawings. In the drawings.

DETAILED DESCRIPTION OF THE EMBODIMENTS

Figure 1:
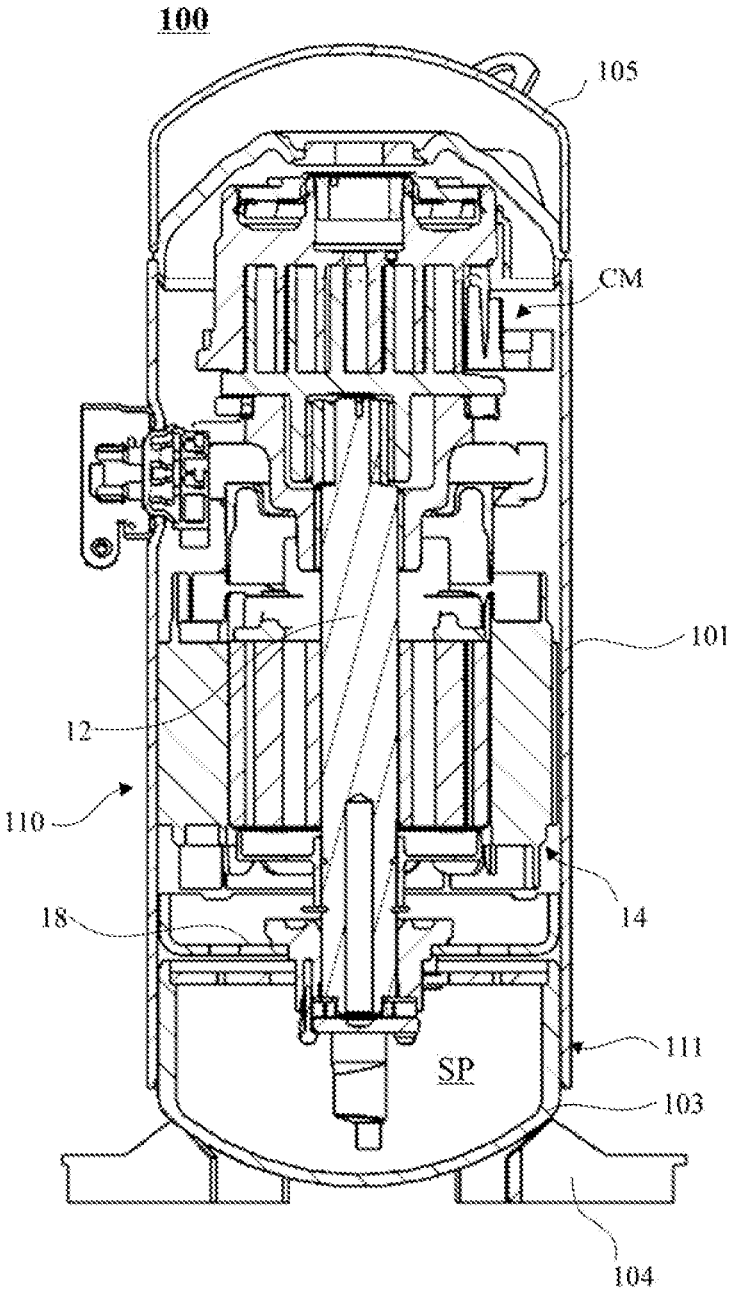
FIG. 1 is a schematic vertical sectional view of a compressor according to a first embodiment of the present disclosure.

Exemplary embodiments will now be described more comprehensively with reference to the accompanying drawings.

Exemplary embodiments are provided so that the present application will be thorough and will more fully convey the scope to those skilled in the art. Many specific details such as examples of specific components, devices, and methods are described to provide a thorough understanding of various embodiments of the present application. It will be clear to those skilled in the art that the exemplary embodiments may be implemented in many different forms without using specific details, none of which should be construed as limiting the scope of the present application. In some exemplary embodiments, well-known processes, well-known device structures, and well-known technologies are not described in detail.

A compressor 100 according to a first embodiment of the present disclosure is described below with reference to FIGS. 1 to 5. As shown in the figures, the compressor 100 includes: a compression mechanism CM for compressing the working fluid, a crankshaft (also called a drive shaft or a rotating shaft) 12 for driving the compression mechanism CM, a motor 14 for driving the crankshaft 12 to rotate, a main bearing block 16 (also known as an upper bearing block) that rotatably supports an upper part of the crankshaft 12 through a bearing, and a bearing block 18 (also known as a lower bearing block) that rotatably supports a lower part of the crankshaft 12 through a bearing.

The compression mechanism CM, the crankshaft 12, the motor 14, the main bearing block 16 and the bearing block 18 are accommodated in a housing 110. The housing 110 includes a cylindrical body 101, a bottom cover 103 (also called a first cover) located at a lower end of the cylindrical body 101, and a top cover 105 (also called a second cover) located at an upper end of the cylindrical body 101. The bearing block 18 is located in the space SP below the motor 14. The space SP is defined by the motor 14 and the housing 110 (specifically, a lower part of the cylindrical body 101 and the bottom cover 103). The bearing block 18 is fixedly attached to the cylindrical body 101.

The bottom cover 103 includes a base part 131 and an axial extension part 132. The base part 131 has a substantially partial spherical shape. The axial extension part 132 extends from a circular outer periphery of the base part 131 in an axial direction of the compressor 100. The axial extension part 132 is interference-fitted in the cylindrical body 101, thereby forming the cylindrical reinforcing part 111 of the housing 110.

The cylindrical reinforcing part 111 has an increased thickness and increased rigidity compared with the cylindrical body 101. Since the rigidity of the cylindrical reinforcing part 111 is greater than the rigidity of other parts of the housing 110, noise radiation can be significantly reduced. In addition, the cylindrical body 101 is in interference fit with the axial extension part 132, so that part of energy can be absorbed by slight relative frictional movement between the cylindrical body and the axial extension part, that is, noise radiation is reduced by increasing damping.

Figure 2:
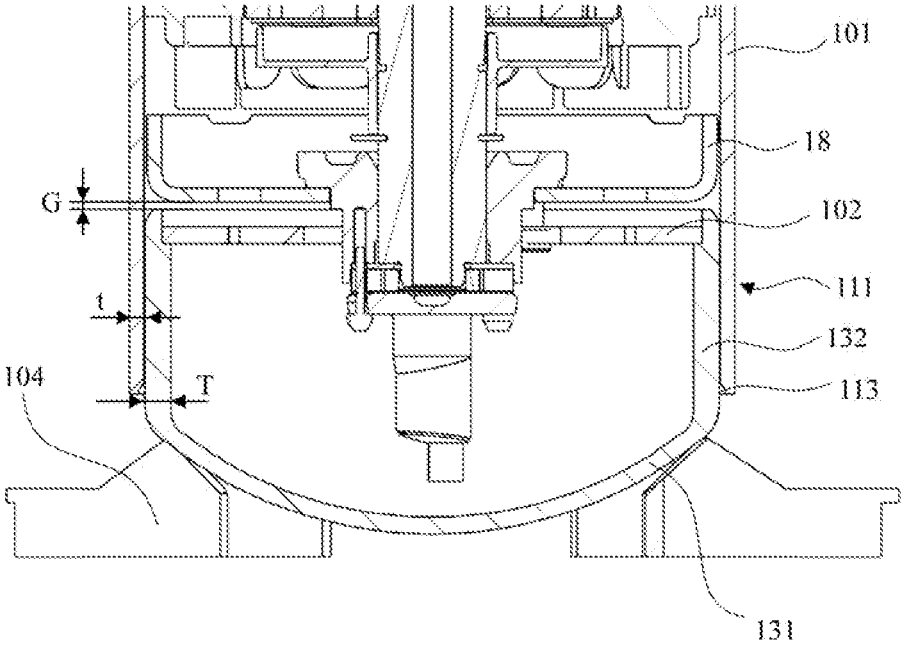
FIG. 2 is a schematic partially enlarged view of the compressor of FIG. 1.
Figure 3:
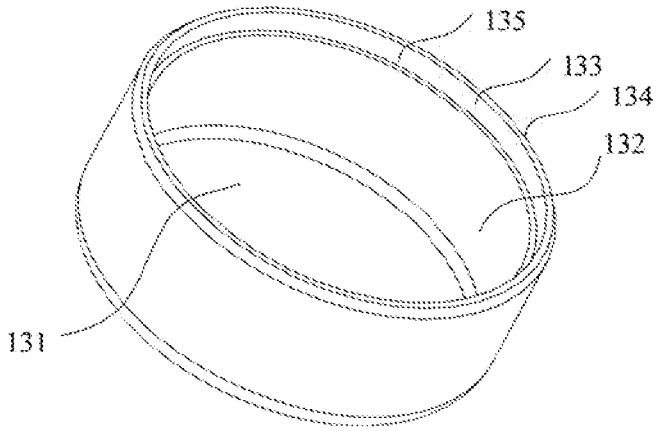
FIGS. 3 and 4 are schematic perspective view and sectional view of a bottom cover of the compressor of FIG. 1, respectively.
Figure 4:
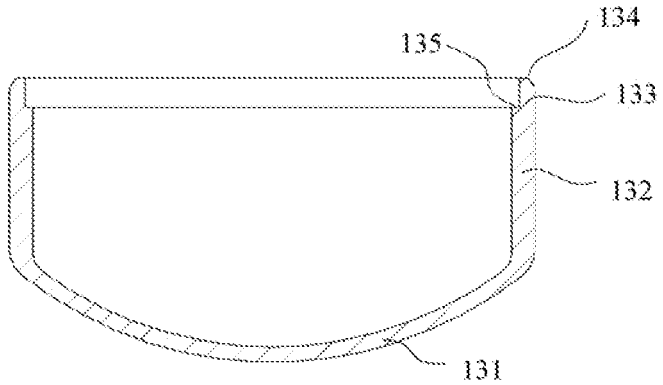
Figure 5:
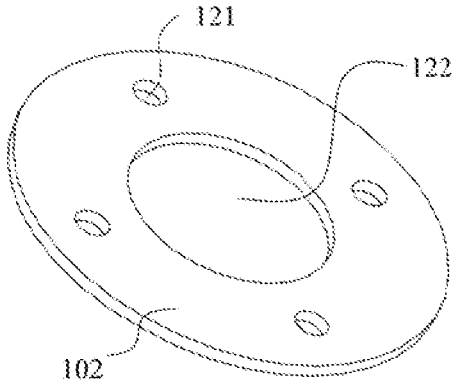
FIG. 5 is a schematic perspective view of a support plate of the compressor of FIG. 1.
Figure 6:
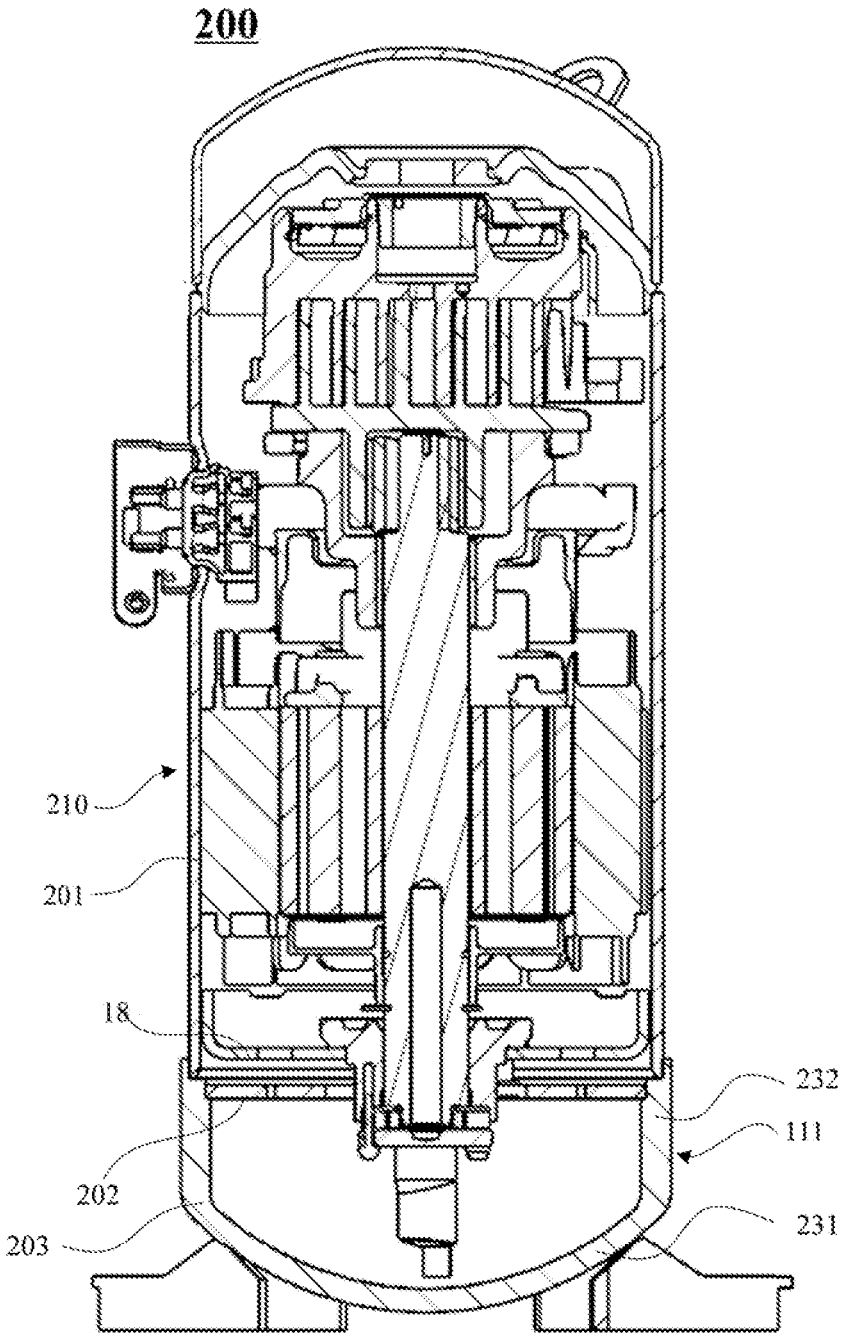
FIG. 6 is a schematic vertical sectional view of the compressor according to a second embodiment of the present disclosure.
Figure 7:
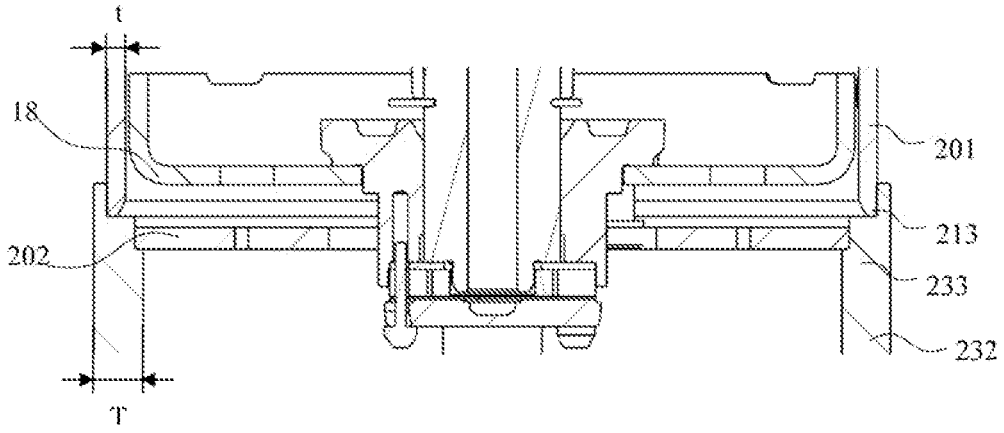
FIG. 7 is a schematic partially enlarged view of the compressor of FIG. 6.
Figure 8:
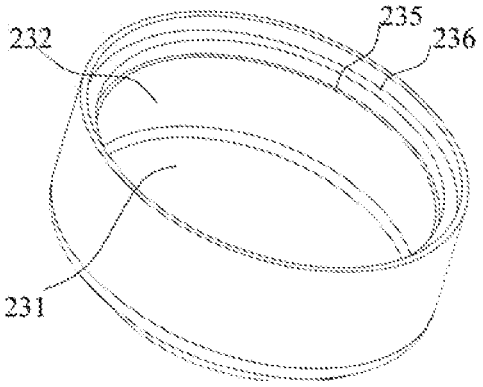
FIGS. 8 and 9 are schematic perspective view and sectional view of the bottom cover of the compressor of FIG. 6, respectively.
Figure 9:
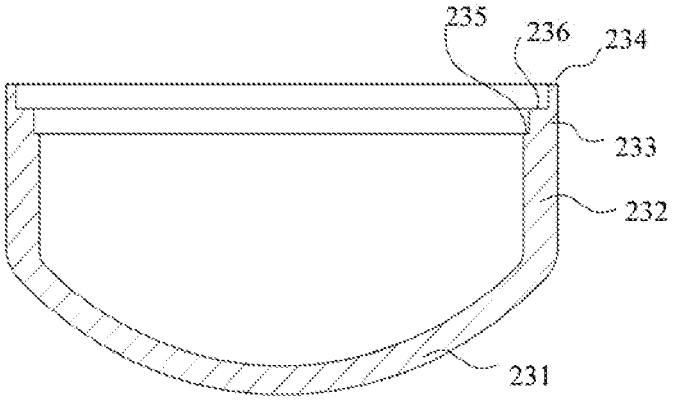

The total weight of the bottom cover 103 is increased due to provision of the axial extension part 132, which is also conducive to reducing noise. The thickness T of the axial extension part 132 may be greater than or equal to the thickness t of the cylindrical body 101. In the example of FIG. 2, the thickness T of the axial extension part 132 is greater than the thickness t of the cylindrical body 101. In addition, the thickness T of the axial extension part 132 may also be greater than the thickness of the base part 131.

The "axial extension part" mentioned here is a part with an axial extension height that can significantly reduce noise, rather than a flange that extends in the axial direction for the purpose of installation, positioning or attachment in the usual sense. For example, in the embodiments of FIGS. 1 to 5, an axial height measured from a bottom surface of the bearing block 18 to a circular outer periphery of the base part 131 of the bottom cover 103 is H, and the axial extension height of the axial extension part 132 is greater than or equal to half of H. In order to reduce the noise better, the axial extension part 132 may be extended as far as possible toward the bearing block 18. In order to avoid interference with the bearing block 18, a certain gap G is formed between the end face 134 of the axial extension part 132 and the bearing block 18. The gap G may be greater than or equal to 0.5 mm and less than or equal to 3 mm.

Therefore, in the compressor according to the first embodiment of the present disclosure, noise radiation can be significantly reduced only by improving the structure of the bottom cover 103, and the manufacturing process and cost are significantly reduced.

Further, the lower end 113 of the cylindrical body 101 may be welded to the axial extension part 132 of the bottom cover 103. For example, the lower end 113 of the cylindrical body 101 is welded 360 degrees in a circumferential direction to the axial extension part 132 of the bottom cover 103, that is, there is an annular weld seam between the lower end 113 of the cylindrical body and the axial extension part 132.

In this way, the cylindrical body 101 and the bottom cover 103 are firmly attached, and the noise radiation is further reduced.

In the embodiments of FIGS. 1 to 5, a support plate 102 may be further provided. The support plate 102 is interference-fitted at the end 133 (which may be referred to as the upper end or the free end) of the axial extension part 132. In this way, the support plate 102 can improve the radial rigidity of the bottom cover 103, and thus the radial rigidity of the housing. In this way, the noise can be further reduced.

The top surface 134 of the end 133 of the axial extension part 132 may be recessed to form a stepped surface 135. The support plate 102 may abut on the stepped surface 135. This is beneficial to the installation, support and positioning of the support plate 102. The support plate 102 is in the form of a flat plate. The support plate 102 may be provided with a central through hole 122 to allow the crankshaft 12 to pass through, thus generally in an annular shape. A hole 121 may be provided in the support plate 102 for ventilation, oil return or other purposes.

Multiple independent support legs 104 may be arranged on an outer surface of the base part 131 of the bottom cover 103, so as to support the compressor 100 on an external structure (such as a floor, etc.). For example, three or four support legs 104 may be provided. The independent support legs 104 can reduce the radiation area of noise, thereby reducing noise radiation. It should be understood that the shape, structure and number of the support legs 104 are not limited to the specific example shown, as long as the support leg(s) can reduce the radiation area of noise while having the sufficient supporting strength.

FIGS. 6 to 9 illustrate a compressor 200 according to a second embodiment of the present disclosure. The compressor 200 is different from the compressor 100 in the attachment between the bottom cover 203 and the cylindrical body 201.

Referring to FIGS. 6 to 9, the bottom cover 203 includes a base part 231 and an axial extension part 232. The axial extension part 232 extends from a circular outer periphery of the base part 231 in an axial direction of the compressor 200. The thickness of the axial extension part 232 is greater than the thickness of the cylindrical body 201, thereby forming the cylindrical reinforcing part 211 of the housing 210. For example, the thickness T of the axial extension part 232 is greater than or equal to twice the thickness t of the cylindrical body 201.

The cylindrical reinforcing part 211 has an increased thickness and increased rigidity compared with the cylindrical body 201. Since the rigidity of the cylindrical reinforcing part 211 is greater than the rigidity of other parts of the housing 210, noise radiation can be significantly reduced.

The end 233 of the axial extension part 232 and the end 213 of the cylindrical body 201 are fixed to each other, for example, by welding. For example, there is an annular weld seam between the end 233 of the axial extension part 232 and the end 213 of the cylindrical body 201, that is, it is welded 360 degrees in the circumferential direction of the ends.

A top surface 234 of the axial extension part 232 may be recessed to form a first step surface 236, so that the end 213 of the cylindrical body 201 may abut on the first step surface 236. This is beneficial to the installation, support and positioning of the cylindrical body 201. In addition, the top surface 234 of the axial extension part 232 may be further recessed to form a second step surface 235, so that the support plate 202 may abut on the second step surface 235. This is beneficial to the installation, support and positioning of the support plate 202. The second step surface 235 is located radially inward of the first step surface 236. The structure of the support plate 202 may be the same as the structure of the support plate 102.

Figure 10:
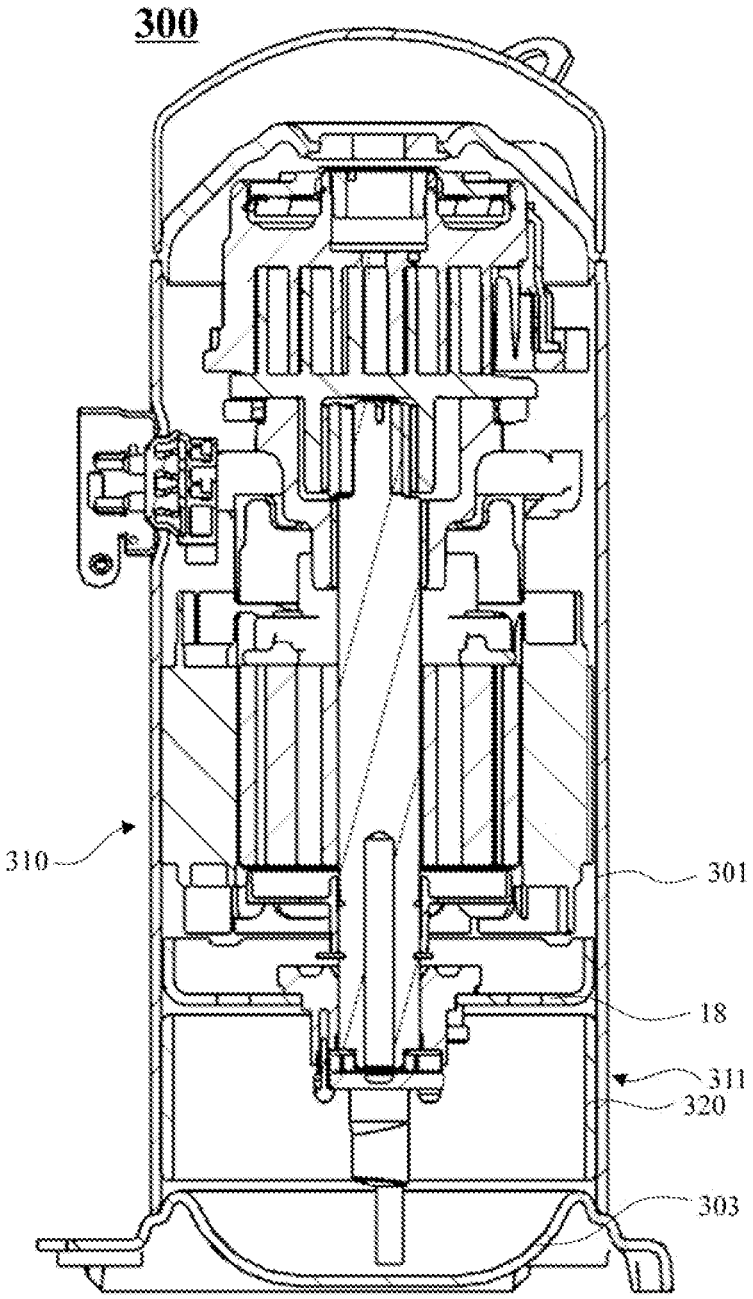
FIG. 10 is a schematic vertical sectional view of the compressor according to a third embodiment of the present disclosure.
Figure 11:
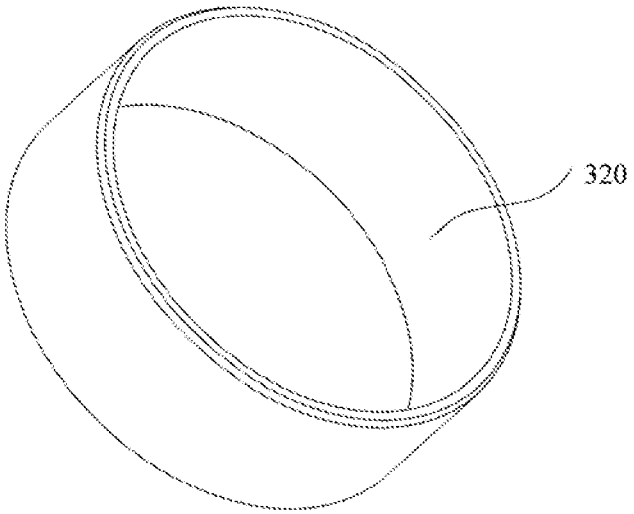
FIG. 11 is a schematic perspective view of a reinforcement member of the compressor of FIG. 10.

FIGS. 10 and 11 illustrate a compressor 300 according to a third embodiment of the present disclosure. The compressor 300 is different from the compressor 100 in that: a separate reinforcement member 320 is provided to replace the axial extension part of the bottom cover.

Referring to FIGS. 10 and 11, the compressor 300 includes a separate reinforcement member 320. The reinforcement member 320 is cylindrical and is interference-fit in the cylindrical body 301, thereby forming the cylindrical reinforcing part 311 of the housing 310. In the compressor 300, the bottom cover 303 does not have an axial extension part that is interference-fitted in the cylindrical body 301.

The cylindrical reinforcing part 311 has an increased thickness and increased rigidity compared with the cylindrical body 301. Since the rigidity of the cylindrical reinforcing part 311 is greater than the rigidity of other parts of the housing 310, noise radiation can be significantly reduced.

The reinforcement member 320 may be made of a material different from the material of the housing 310. During the operation of the compressor, the expansion rates of the materials of the reinforcement member 320 and the housing 310 are different, and there is a slight relative motion between the reinforcement member 320 and the housing 310, thereby increasing damping and thus reducing noise radiation.

Figure 12:
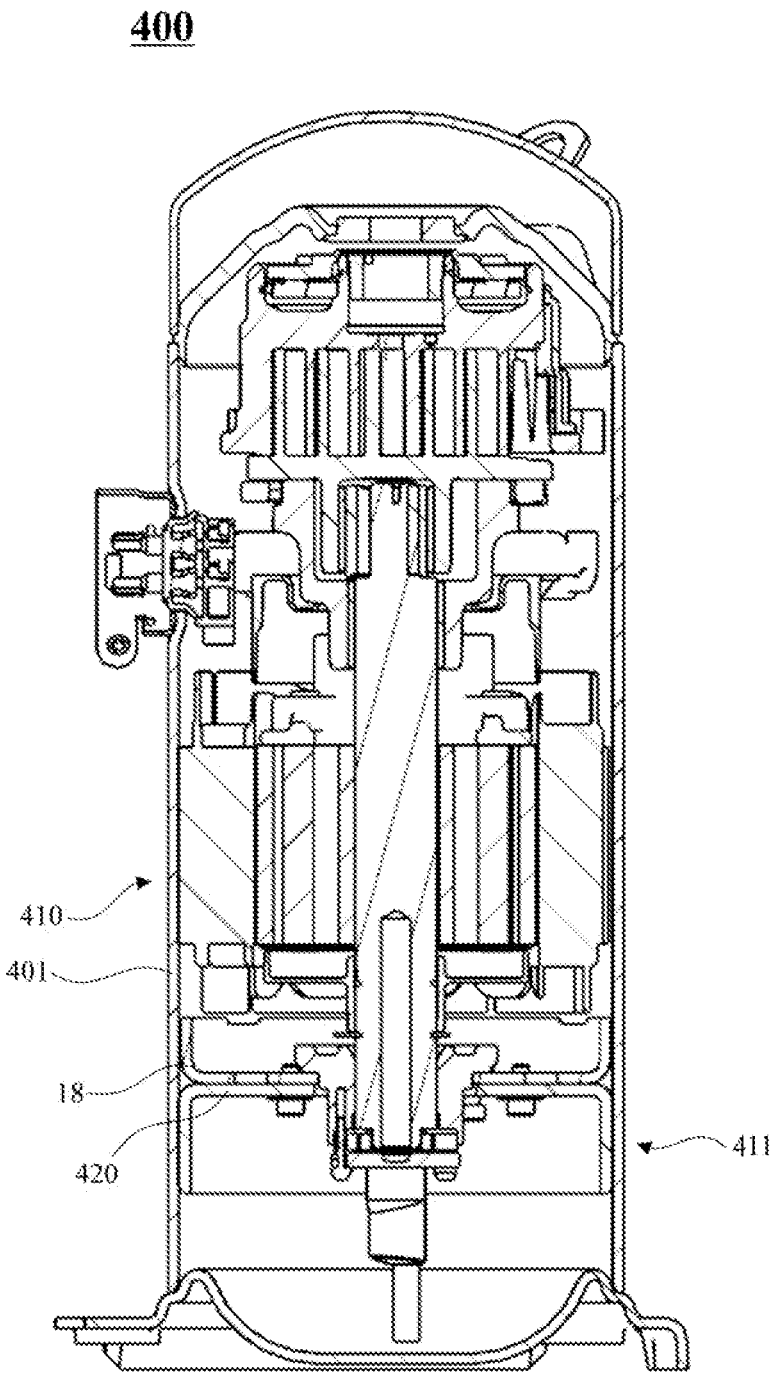
FIG. 12 is a schematic vertical sectional view of the compressor according to a fourth embodiment of the present disclosure.
Figure 13:
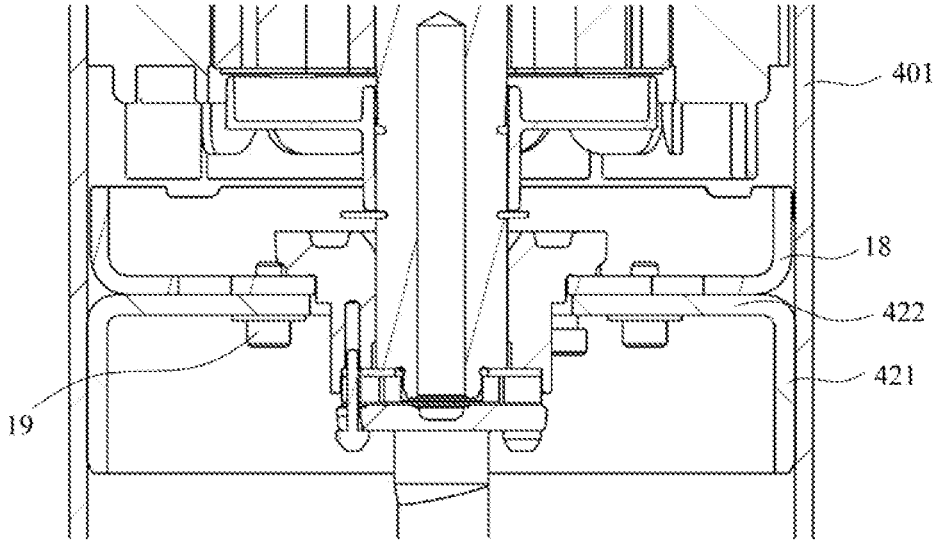
FIG. 13 is a schematic partially enlarged view of the compressor of FIG. 12.
Figure 14:
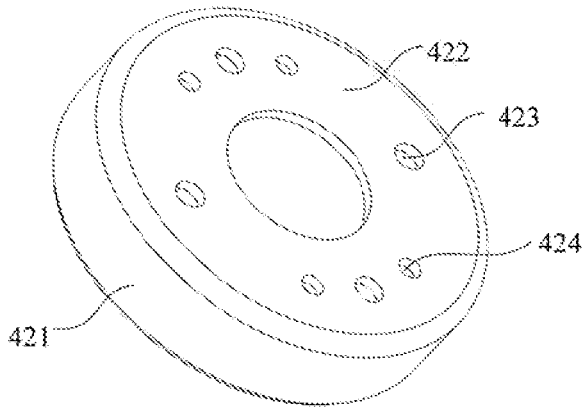
FIG. 14 is a schematic perspective view of the reinforcement member of the compressor of FIG. 12.

FIGS. 12 to 14 illustrate a compressor 400 according to a fourth embodiment of the present disclosure. The compressor 400 is different from the compressor 300 in that: the structure of a separate reinforcement member is different.

Referring to FIGS. 12 to 14, the compressor 400 includes a separate reinforcement member 420. The reinforcement member 420 includes a cylindrical part 421 that is in an interference fit with the cylindrical body 401 and a bottom part 422 extending radially from an end of the cylindrical part. The cylindrical part 421 is in interference fit with the cylindrical body 401, thereby forming the cylindrical reinforcing part 411 of the housing 410.

The cylindrical reinforcing part 411 has an increased thickness and increased rigidity compared with the cylindrical body 401. Since the rigidity of the cylindrical reinforcing part 411 is greater than the rigidity of other parts of the housing 410, noise radiation can be significantly reduced.

The bottom part 422 can play a similar role as the support plate 102, that is, improve the radial rigidity of the cylindrical part 421 and thus the radial rigidity of the housing.

The bottom part 422 may be positioned adjacent to the bearing block 18. In the example as shown, the bottom part 422 is annular and has a hole 423 to receive a fastener, e.g., a bolt 19. The bottom part 422 can be connected to the bearing block 18 by bolts 19. A hole 424 may also be provided in the bottom part 422 for ventilation, oil return or other purposes.

Figure 15:
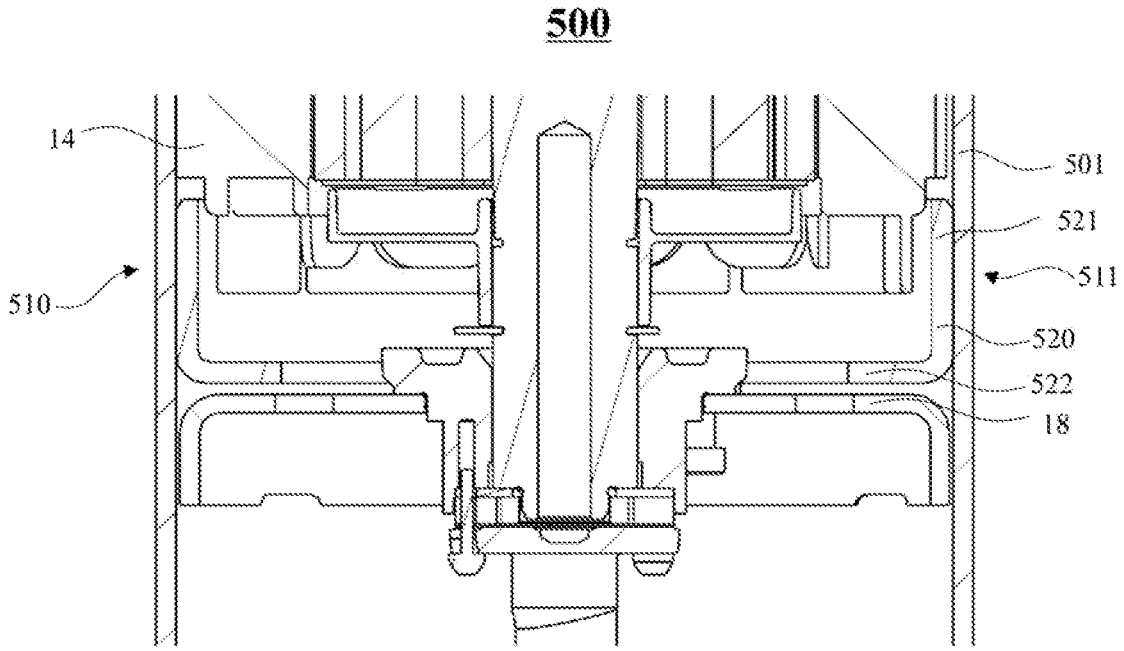
FIG. 15 is a partially enlarged sectional view of the compressor according to a fifth embodiment of the present disclosure.
Figure 16:
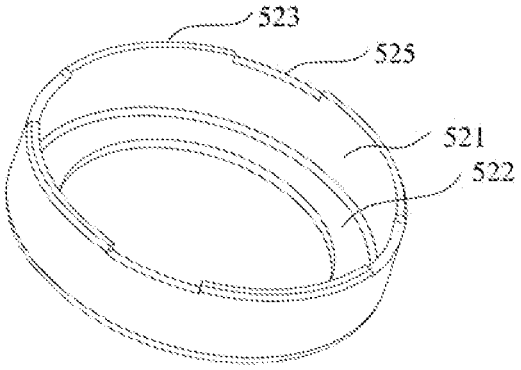
FIG. 16 is a schematic perspective view of the reinforcement member of the compressor of FIG. 15.

FIGS. 15 and 16 illustrate a compressor 500 according to a fifth embodiment of the present disclosure. The compressor 500 is different from the compressor 400 in position of the reinforcement member.

Referring to FIGS. 15 and 16, a single reinforcement member 520 of the compressor 500 is provided between the motor 14 and the bearing block 18. The reinforcement member 520 includes a cylindrical part 521 that is in an interference fit with the cylindrical body 501 and a bottom part 522 extending radially from an end of the cylindrical part 521. The cylindrical part 521 is in interference fit with the cylindrical body 501, thereby forming the cylindrical reinforcing part 511 of the housing 510.

The cylindrical reinforcing part 511 has an increased thickness and increased rigidity compared with the cylindrical body 501. Since the rigidity of the cylindrical reinforcing part 511 is greater than the rigidity of other parts of the housing 510, noise radiation can be significantly reduced.

The bottom part 522 can be positioned adjacent to the bearing block 18. The bottom part 522 may have the same structure as the bottom part 422 shown in FIG. 14, or the bottom part 522 may have a different structure from the bottom part 422 as shown in FIG. 14. In the example shown in FIG. 16, the radial width of the bottom part 522 is small, so there is no mounting hole or hole for other purposes.

The upper end face of the cylindrical part 521 may have a shape matching the motor 14 (the stator of the motor in the illustrated example). As shown in FIG. 16, the upper end face of the cylindrical part 521 has a convex part 523 and a concave part 525. In this example, the reinforcement member 520 may be press-fitted into the housing of the compressor together with the motor 14.

The structure of various components or parts described herein is not limited to the specific example as shown, but can be changed according to actual needs, as long as it can achieve the above object.

Although a scroll compressor is shown in the explanatory drawings, it should be understood that the present disclosure may be applied to any other suitable type of compressor.

Although the present application has been described with reference to exemplary embodiments, it should be understood that the present application is not limited to the specific embodiments described and illustrated herein. Without departing from the scope defined by the appended claims, those skilled in the art can make various changes to the exemplary embodiments. It should further be understood that, provided that there is no contradiction in technical solutions, the features in the various embodiments can be combined with each other, or can be omitted.

The invention claimed is:

1. A compressor, comprising:

a housing, which comprises a cylindrical body, and a first cover and a second cover respectively arranged at two axial ends of the cylindrical body;

a compression mechanism accommodated in the housing and configured to compress a working fluid;

a crankshaft configured to drive the compression mechanism;

a motor configured to drive the crankshaft to rotate, and a bearing block accommodated in a space defined by the motor and the housing and fixedly attached to the housing, wherein the bearing block is configured to rotatably support the crankshaft through a bearing, wherein the housing has a cylindrical reinforcing part for defining the space, a rigidity of the cylindrical reinforcing part is greater than a rigidity of other parts of the housing, wherein the first cover comprises a base part and an axial extension part, the axial extension part extends from an outer periphery of the base part in an axial direction of the compressor, wherein an axial height measured from a bottom surface of the bearing block to the outer periphery of the base part of the first cover is H, and an axial extension height of the cylindrical reinforcing part is greater than or equal to half of H, and wherein a gap is formed between an end face of the axial extension part and the bearing block, the gap is greater than or equal to 0.5 mm and less than or equal to 3 mm.

2. The compressor according to claim 1, wherein the axial extension part is interference-fitted in the cylindrical body to form the cylindrical reinforcing part of the housing.

3. The compressor according to claim 1, wherein an end of the axial extension part is fixedly attached to an end of the cylindrical body, and a thickness of the axial extension part is greater than a thickness of the cylindrical body, the axial extension part forms the cylindrical reinforcing part of the housing.

4. The compressor according to claim 3, wherein the thickness of the axial extension part is greater than or equal to 2 times the thickness of the cylindrical body.

5. The compressor according to claim 2, wherein the first cover is attached to the cylindrical body via an annular weld seam.

6. The compressor according to claim 2, wherein a support plate is provided and interference-fitted at an end of the axial extension part.

7. The compressor according to claim 6, wherein the support plate is an annular flat plate.

8. The compressor according to claim 6, wherein a top of the axial extension part has a concave step surface to support or position the support plate.

9. The compressor according to claim 1, wherein the compressor is a vertical compressor, the first cover is a bottom cover, and the bearing block is a lower bearing block.

10. The compressor according to claim 9, wherein a plurality of independent support legs are arranged on the bottom cover, the support legs are equally spaced along a circumferential direction to support the compressor on an external structure.

11. The compressor according to claim 3, wherein the first cover is attached to the cylindrical body via an annular weld seam.

12. The compressor according to claim 3, wherein a support plate is provided and interference-fitted at the end of the axial extension part.

* * * * *